United States Patent [19]

Dividoff et al.

[11] Patent Number: 4,748,784

[45] Date of Patent: Jun. 7, 1988

[54] TRIANGULATED FRAME STRUCTURES

[75] Inventors: Alexander M. Dividoff, Coogee; Robert Kroie, Lindfield, both of Australia

[73] Assignee: John Lysaght (Australia) Limited, New South Wales, Australia

[21] Appl. No.: 879,123

[22] PCT Filed: Nov. 1, 1984

[86] PCT No.: PCT/AU84/00222

§ 371 Date: Jun. 5, 1986

§ 102(e) Date: Jun. 5, 1986

[87] PCT Pub. No.: WO86/02682

PCT Pub. Date: May 9, 1986

[51] Int. Cl.[4] ..... E04B 1/32

[52] U.S. Cl. ..... 52/639; 29/155 R

[58] Field of Search ..... 52/693, 639, 690–694; 446/488, 87; 29/155 R

[56] References Cited

U.S. PATENT DOCUMENTS

| | | | |
|---|---|---|---|
| 1,451,555 | 4/1923 | Schenstrom | 52/639 X |
| 4,041,659 | 8/1977 | McElhoe | 52/639 X |
| 4,201,021 | 5/1980 | Aldag et al. | 52/639 X |

FOREIGN PATENT DOCUMENTS

| | | | |
|---|---|---|---|
| 75443 | 6/1977 | Australia . | |
| 13107 | 6/1977 | Australia . | |
| 78612 | 9/1977 | Australia . | |
| 31647 | 12/1977 | Australia . | |
| 637328 | 7/1958 | Canada | 52/715 |
| 1399662 | 4/1965 | France | 52/639 |
| 1468354 | 3/1977 | United Kingdom . | |
| 2128286 | 4/1984 | United Kingdom . | |

*Primary Examiner*—Carl D. Friedman

*Attorney, Agent, or Firm*—Barnes & Thornburg

[57] ABSTRACT

A method of building a triangulated frame structure of the kind composed of a plurality of subsidiary members (12) joined by their ends to a plurality of main members (7,8,11) intermedially of the ends of the main members (7,8,11). The method comprises forming the ends of the subsidiary members (12) as protrusile tongues (13); providing the main members (7,8,11) with locator slots (14) each able to accept one of the tongues (13), and located in the main members (7,8,11) at points to which the end of a subsidiary member (12) is to be joined; arraying the main members (7,8,11) and the subsidiary members (12) together substantially in correspondence with the position they are to occupy in the finished frame structure, entering the tongues (13) into that one of the slots nearest to it when the members (7,8,11,12) are in the arrayed position; and bending the entered tongues (13) so that they are at least partially restrained against withdrawal from the slots 14.

11 Claims, 2 Drawing Sheets

TRIANGULATED FRAME STRUCTURES

TECHNICAL FIELD

This invention relates to triangulated frame structures such as roof trusses, girders and others. Frame structures of the kind in question (hereinafter referred to simply as "trusses") comprise: a top chord, a bottom chord and a plurality of brace members which extend between the chords and have their ends respectively secured thereto.

Where the truss is in the form of a warren girder (for example) the two chords are usually parallel. Where the structure is a roof truss, it is common for the top chord to be in two parts having upper ends, which meet in a ridge, and lower or eave ends. The ends of the bottom chord (in such case) are secured to the top chord parts adjacent their eave ends.

BACKGROUND ART

In a purely structural sense, the prior trusses of the type discussed have been satisfactory, but their assembly and installation have not been so.

In the interests of production efficiency the practice has grown for trusses to be built in the workshop and then taken to the site ready for installation.

This in-factory production has been successful, largely because it permits the truss parts to be assembled, and the securing of the truss parts to be effected, in a jig ensuring speed and accurate uniformity of truss formation.

Notwithstanding the considerable utility of jigs in truss production, their use has its drawbacks.

In the first place, truss jigs are relatively bulky, and thus present a storage problem. A separate size of jig is required for each truss size or form, unless the jigs are furnished with movable parts; but, even if that be done, a further disability arises because it increases the complexity of the jig design and it involves time-losses in re-locating and re-setting of the jig parts to suit each different truss size or kind. Another shortcoming in the use of jigs is that where (as is usually the case) the joints connecting the truss chords and other members are made (by welding, riveting or otherwise) while the truss assembly is still in the jig; the option to assemble the truss at the workshop or at the site is denied to the builder in the case of trusses too large for convenient transport.

DISCLOSURE OF THE INVENTION

The object of this invention is to remedy the situation outlined above very simply; by the provision of a method of building a frame structure which enables the frame parts to be assembled and connected together without need for jigs, without loss of accuracy or production efficiency and with the option to assemble the frame parts in the factory or on the site fully available to the builder as may seem expedient.

The invention provides:

A method of building a triangulated frame structure of the kind composed of a plurality of subsidiary members joined by their ends to a plurality of main members intermedially of the ends of said main members; said method comprising:

(a) forming the ends of at least some of said subsidiary members as protrusile tongues, (b) providing said main members with a plurality of locator slots each able to accept one of said tongues within it, and located in said main members at points therein to which the end of a subsidiary member is to be joined;

(c) arraying said members together substantially in correspondence with the position they are to occupy relative to other members in the finished frame structure by entering said tongues into that one of said slots nearest to it when said members are arrayed as aforesaid, and (d) bending said entered tongues so that they are at least partially restrained against withdrawal from said slots.

Examples of the invention, as applied to a roof truss, are illustrated in the drawings herewith.

BEST MODE OF CARRYING OUT THE INVENTION

Figures 1, 2:
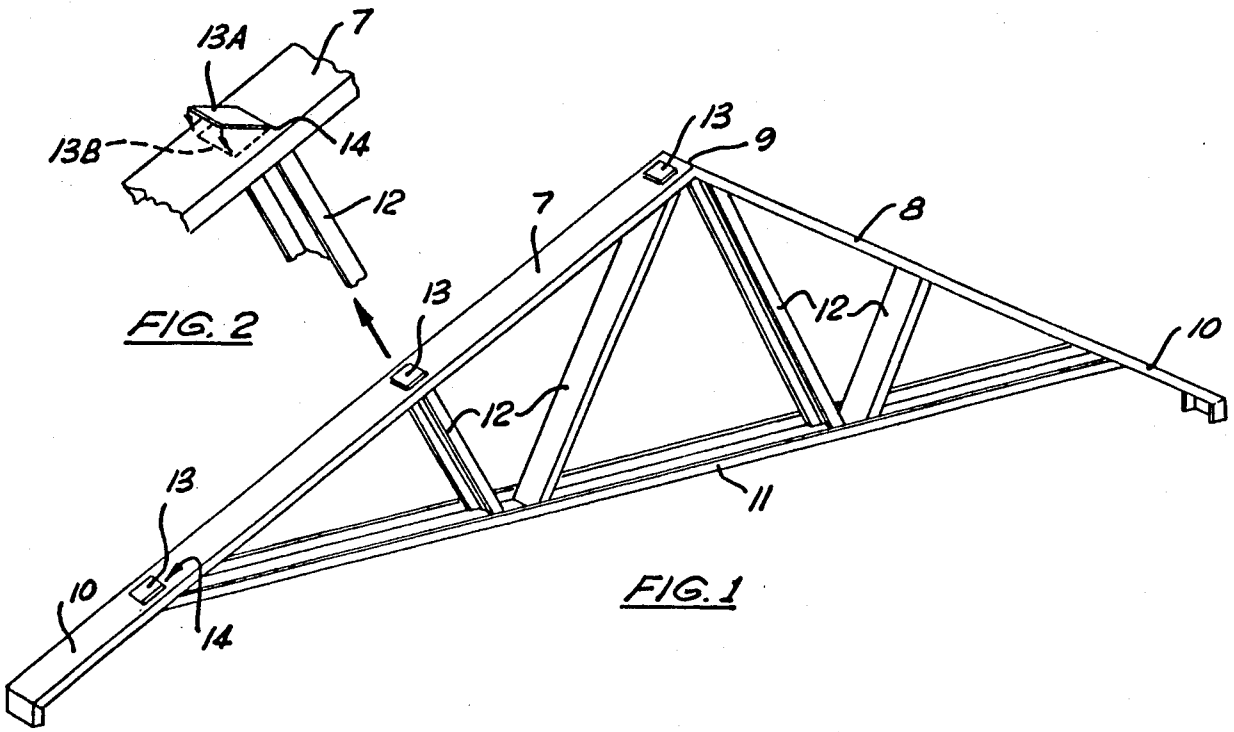
FIG. 1 is a perspective view of a roof truss.
FIG. 2 repeats a fragment of FIG. 1 on an enlarged scale, and shows one of the tongues in course of truss assembly.

Referring to FIGS. 1 to 5; the top chord is in two parts 7 and 8. These meet in a ridge 9 and have eave end portions 10. A bottom chord 11 extends between and has its ends secured to portions 10. A plurality of brace members 12 have ends secured to one of the parts 7 or 8 and their other ends to bottom chord 11.

The ends of the bottom chord 11 and the ends of the braces 12 are formed with tongues 13 which protrude from the extreme ends of the members concerned.

The chords 7/8 and 11 are pierced by slots 14 at those points where a joint is required to be made.

When the truss is to be assembled, the parts for it may be laid out (on the ground, for example) in rough accord with the arrangement of them required in the finished truss. The tongues 13 are then entered into the appropriate slots 14. When so entered, the tongues are bent over (by hammering or otherwise) so to connect the parts concerned together, at least sufficiently to ensure accurate and sustained location of each of those parts relative to the other. In FIG. 2 one of the tongues is shown partly bent at 13A and fully bent by dotted lines 13B.

Figures 3, 4, 5, 6:
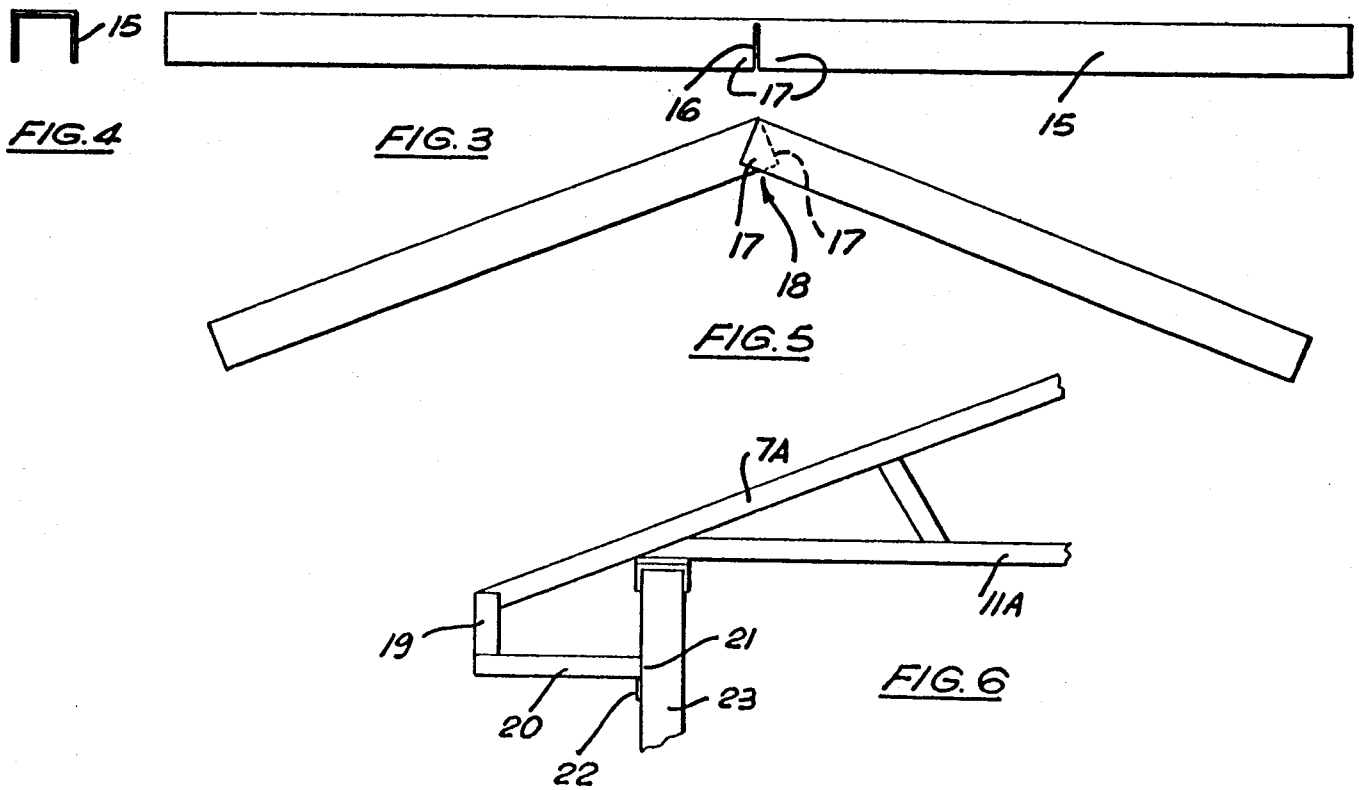
FIG. 3 is a side elevation of a two-part top chord in course of preparation.
FIG. 4 is an end elevation projected from FIG. 3.
FIG. 5 repeats FIG. 3 except for showing the top chord prepared for truss incorporation.
FIG. 6 shows a fragment of the same truss except for its inclusion of a minor modification.

It will be understood that with some trusses (mainly dependant upon its expected working load conditions) the upper ends of the top chord parts, meeting in ridge 9, may simply butt one against the other; or, as an alternative to simply butting, the end of one part may be pre-joggled to nest inside the other. In most cases however, it is preferable for the meeting ridge ends to be joined together. This may be done in any conventional way. For preference however, the two parts 7 and 8 are made in one straight piece as shown at 15 in FIG. 3, this piece is then bent at the required ridge point to give the required top chord form. To facilitate this bending, the "one-piece" chord member may be slit (by sawing or otherwise) almost right through as indicated at 16. If the top chord is of light-weight channel material (as indicated by FIG. 4) the corners 17, produced by the slitting, may simply be lapped as at 18 in FIG. 5. Alternatively, the corners 17 of one part may be pre-joggled to fit between the corners 17 of the other part. As a further alternative, the one-piece chord member 15 may be vee-notched or vee-folded instead of merely being slit.

In structures of extreme light weight, and in respect of members in compression when loaded, the bending over of tongues 13, as described above, may constitute the sole means whereby a joint is made. Also however, each or any of the joints may be additionally secured to ensure against coming apart when under load. The additional securing means may consist of spot welding, pop-riveting, bolting or other common fastening expedient applied to the bent tongues 13 and the parts into contact with which they have been bent, or to flanges or other parts of the joined members.

It will be noted that bottom chord 11 is present in the illustrated truss in two capacities; in that, it is a subsidiary members insofar as it has its ends joined to top chord parts 9 and it is a main member insofar as it has the ends of brace members 11 joined to it.

The truss partly shown in FIG. 6 corresponds with that described above except for its inclusion of means to support an eave-soffit panel.

The arrangement of FIG. 6 includes a top chord 7A and a bottom chord 11A in the same way as previously explained. In addition however, top chord 7A is extended by having an upright suspension member 19 depending from it. This member is joined to the proximal end of a soffit panel support member 20 whereof the distal end 21 is joined, by way of downbent lug 22 for example to the wall or other structure 23 upon which the truss rests.

The members 19 provide a mounting for guttering and or facia, and the members provide support for conventionally installed soffit panels.

It will be appreciated that parts 19 and 20 may be formed as one piece joined to chord 7A by welding, pop-riveting or otherwise. Alternatively parts 19, 20 and 7A may each be formed separately and conventionally joined together in the manner indicated, and as a further alternative the chord 7A and parts 19 and 20 may be integrally joined in one-piece. This last mode would be very suitable where the members concerned are made as light-gauge sheet-steel channels as the formation of parts 19 and 20 could be effected entirely by channel flange slitting followed by channel web bending, still further followed, if desired, by soldering, welding, riveting etc. of the lapping flange portions so produced.

We claim:

1. A method of building a triangulated frame structure for load carrying purposes in a roof of a building and comprising a plurality of subsidiary members joined by their ends to a plurality of main members intermedially of the ends of said main members; said method comprising:

(a) forming the main members and subsidiary members from channel section in metal, each channel section including a web and flanges extending away from the web in the same direction, the ends of at least some of said subsidiary members being formed as protrusile tongues extending from the webs, (b) providing said main members with a plurality of locator slots in the webs thereof, each locator slot able to accept one of said tongues within it, and located in said main members at points therein to which the end of a subsidiary member is to be joined;

(c) arraying said members together substantially in correspondence with the position they are to occupy relative to other members in the finished frame structure with the main members forming a generally peripheral portion of the frame structure and with end portions of the subsidiary members having their flanges disposed for fitting between flanges of the main members, and entering each of said tongues into that one of said slots nearest to it when said members are arrayed as aforesaid, (d) bending said entered tongues so that they are at least partially restrained against withdrawal from said slots and thereby establishing the geometry of the frame structure, and (e) rigidly interconnecting the frame structure at overlapping flanges of the subsidiary members and main members.

2. A method according to claim 1 wherein said plurality of main members are arrayed as top chord parts which meet in a ridge and have eave end portions, said subsidiary members are arrayed as bracing members, and a bottom chord which in relation to said brace members is arrayed as a main member, and in relation to said chord parts (constitutes) is arrayed as a subsidiary member.

3. A method according to claim 1 which includes the step of forming eave-soffit support means on the eave ends of said top chords.

4. A method according to claim 3 wherein said eave-soffit supports are formed integrally with said top chords.

5. A method according to claim 1 wherein at least some of the flanges of the subsidiary members are arrayed for fitting between the flanges of the main members with an edge portion angled with respect to the web portion of the subsidiary member and in parallel to the web of at least one of the main members.

6. A method according to claim 5 wherein a flange of at least one of the main members is cut through to its web and wherein the web is bent at the cut so as to cause that main member to be V-shaped in longitudinal direction to provide for the triangularity of the frame structure.

7. A method according to claim 1 wherein a flange of at least one of the main members is cut through to its web and wherein the web is bent at the cut so as to cause that main member to be V-shaped in longitudinal direction to provide for the triangularity of the frame structure.

8. A triangulated frame structure for load carrying purposes in a roof of a building comprising: a plurality of subsidiary members joined by their ends to a plurality of main members intermedially of the ends of said main members wherein:

(a) the main members and subsidiary members are metal with channel sections, each channel section including a web and flanges extending away from the web in the same direction, the ends of at least some of said subsidiary members being formed as protrusile tongue means extending from the webs;

(b) said members having a plurality of locator slots in the webs thereof with each locator slot accepting one of said tongues means of said subsidiary members within it;

(c) the main members forming a generally peripheral portion of the triangulated frame structure and with end portions of the subsidiary members having their flanges interfitting with flanges of the main members;

(d) said tongue means bent over the webs of the main members so that the subsidiary members are at least partially restrained against withdrawal from said slots to thereby establishing the geometry of the frame structure, and (e) the flanges of the subsidiary members being rigidly interconnected to the flanges of the main members at the points where the flanges of the subsidiary members and the main members interfit.

9. The triangulated frame structure of claim 8 wherein at least some of the flanges of the subsidiary members disposed for fitting between the flanges of the main members have an edge portion angled with respect to the web portion of the subsidiary member and in parallel to the web of at least one of the main members.

10. The triangulated frame structure of claim 9 wherein one of the main members having its flanges cut through its web and bent at its web to form a V-shape to provide for the triangularity of the frame structure and with portions of the flanges overlapping at the cut.

11. The triangulated frame structure of claim 8 wherein at least some of the flanges of the subsidiary members disposed for fitting between the flanges of the main members have an edge portion angled with respect to the web portion of the subsidiary member and in parallel to the web of at least one of the main members.

* * * * *